United States Patent [19]

Seitzer

[11] 4,456,533

[45] Jun. 26, 1984

[54] RECOVERY OF BITUMEN FROM BITUMINOUS OIL-IN-WATER EMULSIONS

[75] Inventor: Walter H. Seitzer, West Chester, Pa.

[73] Assignee: Suncor, Inc., Toronto, Canada

[21] Appl. No.: 491,152

[22] Filed: May 4, 1983

Related U.S. Application Data

[63] Continuation of Ser. No. 253,474, Apr. 13, 1981, abandoned.

[51] Int. Cl.[3] ..... C10G 1/04

[52] U.S. Cl. ..... 210/708; 208/11 LE; 210/738

[58] Field of Search ..... 208/11 LE; 210/702, 210/703, 708, 712, 738, 767, 768, 800

[56] References Cited

U.S. PATENT DOCUMENTS

| | | | |
|---|---|---|---|
| 3,268,071 | 8/1966 | Puddington et al. | 210/738 |
| 3,526,585 | 9/1970 | Camp | 210/734 |
| 3,556,980 | 1/1971 | Clark et al. | 208/11 LE |
| 3,560,371 | 2/1971 | Kaminsky | 208/11 R |
| 4,018,664 | 4/1977 | Bain et al. | 208/11 LE |
| 4,096,057 | 6/1978 | Porritt et al. | 208/11 LE |
| 4,392,941 | 7/1983 | Roth et al. | 210/738 |

FOREIGN PATENT DOCUMENTS

| | | |
|---|---|---|
| 842203 | 5/1970 | Canada . |
| 975700 | 10/1975 | Canada . |
| 975699 | 10/1975 | Canada . |
| 975698 | 10/1975 | Canada . |
| 975697 | 10/1975 | Canada . |
| 975696 | 10/1975 | Canada . |

*Primary Examiner*—Peter A. Hruskoci

*Attorney, Agent, or Firm*—Paul Lipsitz

[57] ABSTRACT

Bitumen recovery from a tar sands emulsion or other bituminous oil-in-water emulsion is increased by milling the emulsion for a time sufficient to cause a bitumen-rich liquid fraction to rise to the surface, and separating such fraction. Addition of water to the starting emulsion or during milling further enhances the recovery of bitumen.

5 Claims, 1 Drawing Figure

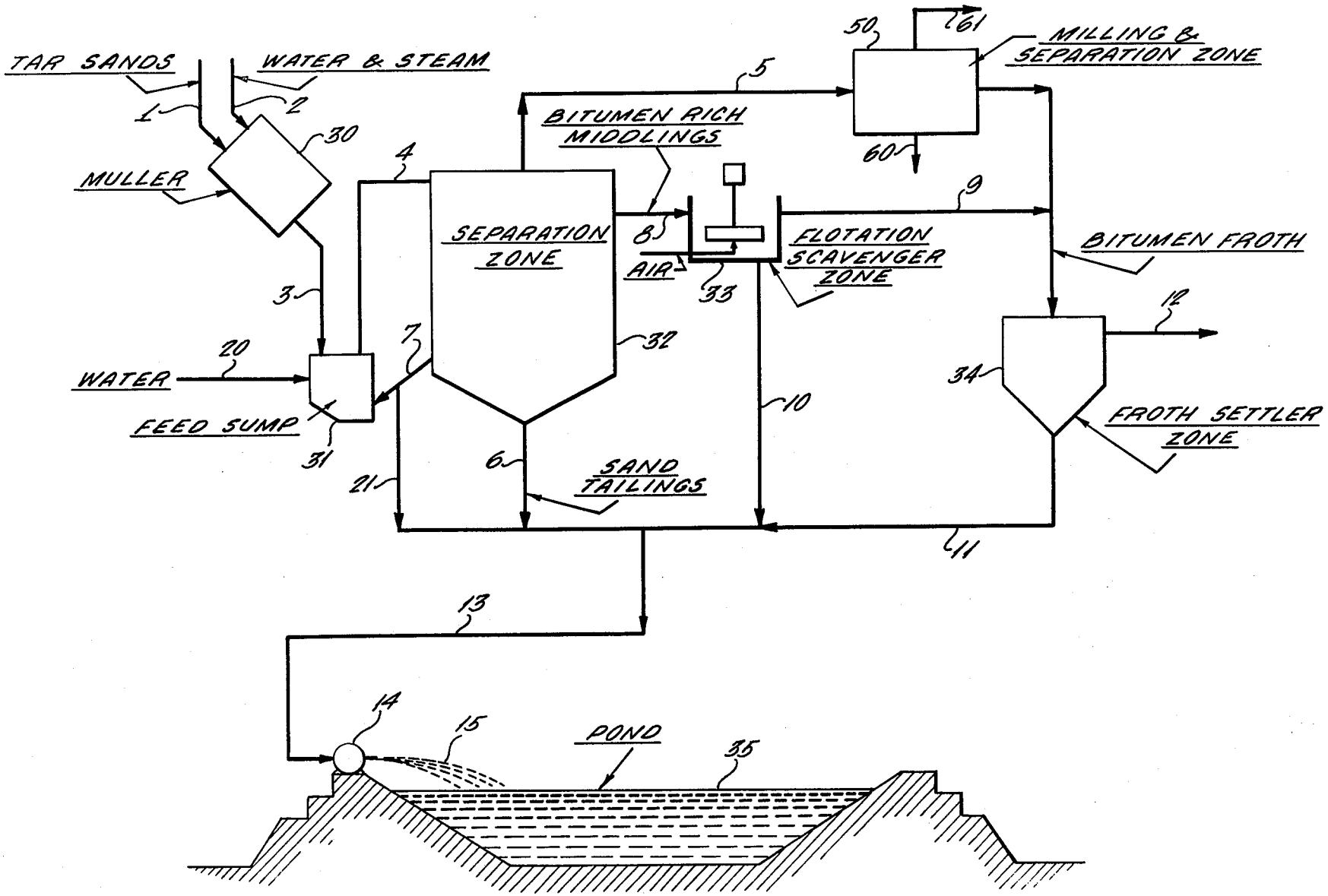
MILLING & SEPARATION ZONE
BITUMEN FROTH
FROTH SETTLER ZONE
FLOTATION SCAVENGER ZONE
BITUMEN RICH MIDDLINGS
SEPARATION ZONE
SAND TAILINGS
AIR
POND
WATER & STEAM
TAR SANDS
MULLER
WATER
FEED SUMP

RECOVERY OF BITUMEN FROM BITUMINOUS OIL-IN-WATER EMULSIONS

CROSS REFERENCE TO RELATED APPLICATIONS

This application is a continuation of Ser. No. 253,474 filed Apr. 13, 1981, now abandoned.

BACKGROUND OF THE INVENTION

The present invention relates generally to an improvement in the recovery of bitumen from tar sands. The invention further relates to an improvement in the recovery of bitumen in aqueous processes for extracting bitumen from tar sands. This invention particularly relates to processing bituminous oil in water emulsions obtained from treating tar sands. The emulsion can also contain a relatively large amount of minerals. Thus, in one embodiment the emulsion can be obtained from treating the sludge layer from a retention pond. The emulsion can also contain a relatively large amount of minerals.

Tar sands are also known as oil sands or bituminous sands. The sand deposits are found in numerous locations throughout the world, e.g., Canada, United States, Venezuela, Albania, Rumania, Malagasy and U.S.S.R. The largest deposit, and the only one of present commercial importance is in the northeast of the Province of Alberta, Canada.

Tar sand is a three-component mixture of bitumen, mineral and water. Bitumen is the component for the extraction of which tar sands are mined and processed. The bitumen content is variable, avaraging 12 wt.% of the deposit, but ranging up to 18 wt.%, and as used herein bitumen includes hydrocarbons. Water typically runs 3 to 6 wt.% of the mixture, increasing as bitumen content decreases. The mineral content constitutes the balance.

Several basic extraction methods have been known for many years for separating the bitumen from the sands. In a "cold water" method, the separation is accomplished by mixing the sands with a solvent capable of dissolving the bitumen. The resulting mixture is then introduced into a large volume of water, water with a surface active agent added, or a solution of a neutral salt in water. The combined mass is then subjected to a pressure or gravity separation.

The "hot water" process for primary extraction of bitumen from tar sands consists of three major process steps (a fourth step, final extraction, is used to clean up the recovered bitumen for further processing). In the first step, called conditioning, tar sand is mixed with water and heated with open steam to form a pulp of 70–85 wt.% solids. Sodium hydroxide or other reagents are added as required to maintain the pH in the range of about 8–8.5. In the second step, called separation, the conditioned pulp is diluted further so that settling can take place. The bulk of the sand-sized particles (greater than 325 mesh screen) rapidly settles and is withdrawn as sand tailings. Most of the bitumen rapidly floats (settles upward) to form a coherent mass known in bitumen froth which is recovered by skimming the settling vessel. An aqueous middlings layer containing some mineral and bitumen is formed between these layers. A scavenger step may be conducted on the middlings layer from the primary separation steps to recover additional amounts of bitumen therefrom. This step usually comprises aerating the middlings. The froths recovered from the primary and scavenger steps can be combined, diluted with naphtha and centrifuged to remove more water and residual mineral. The naphtha is then distilled for further processing. Hot water processes were known and described in the prior art. Tailings can be collected from the aforementioned processing steps and generally will contain solids as well as dissolved chemicals. The tailings are collected in a retention pond in which additional separation occurs. The tailings can also be considered as processing water containing solids which are discharged from the extraction process. The tailings comprise water, (both the natural occurring water and added water), bitumen and mineral.

The mineral particle size distribution is particularly significant to operation of the hot water process and to sludge accumulation. The terms "sand", "silt" and "clay" are used in this specification as particle size designations. Sand is siliceous material which will not pass through a 325 mesh screen. Silt will pass through a 325 mesh screen but is larger than two microns and can contain siliceous material. Clay is smaller than 2 microns and also can contain siliceous material. The term "fines" as used herein refers to a combination of silt and clay.

Conditioning tar sands for the recovery of bitumen consists of heating the tar sand/water mixture to process temperature (180°–200° F.), physical mixing of the pulp to uniform composition and consistency, and the consumption (by chemical reaction) of the caustic or other added reagents. Under these conditions, bitumen is stripped from the individual sand grains and mixed into the pulp in the form of discrete droplets of a particle size on the same order as that of the sand grains. During conditioning, a large fraction of the clay particles becomes well dispersed and mixed throughout the pulp. The conditioning process which prepares bitumen from efficient recovery during the following process steps also causes the clays to be the most difficult to deal within the tailings disposal operation.

The conditioned tar sand pulp is screened to remove rocks and unconditionable lumps of tar sands and clay. The reject material, "screen oversize," is discarded. The next process step, called "separation," is the bitumen recovery step. The screened pulp is further diluted with water to promote two settling processes. Globules of bitumen, essentially mineral-free, float upward to form a coherent mass of froth on the surface of the separation units; at the same time, mineral particles, particularly the sand size material, settle down and are removed from the bottom of the separation unit as sand tailings. These two settling processes take place through a medium called the middlings. The middlings consists primarily of water, bitumen particles and suspended fines.

The particular sizes and densities of the sand and of the bitumen particles are relatively fixed. The parameter which influences the settling processes most is the viscosity of the middlings. Characteristically, as the suspended material content rises above a certain threshold, which varies according to the composition of the suspended fines, viscosity rapidly achieves high values with the effect that the settling processes essentially stop. Little or no bitumen is recovered and all streams exiting the unit have about the same composition as the feed. As the feed suspended fines content increases, more water must be used in the process to maintain middlings viscosity within the operable range.

The third step of the hot water process is scavenging. The feed suspended fines content sets the process water requirement through the need to control middlings viscosity which, as noted before, is governed by the clay/water ratio. It is usually necessary to withdraw a drag stream of middlings to maintain the separation unit material balance, and this stream of middlings can be scavenged for recovery of incremental amounts of bitumen. Air flotation is an effective scavenging method for this middlings stream.

Final extraction or froth clean-up is usually accomplished by centrifugation. Froth from primary extraction is diluted with naphtha, and the diluted froth is then subjected to a two-stage centrifugation. The process yields an oil product of essentially pure, but diluted, bitumen. Water and mineral and any unrecovered bitumen removed from the froth constitutes an additional tailing stream which must be disposed of.

In extractive processing, tailings are a throwaway material generated in the course of extracting the valuable material from the non-valuable material, and in tar sands processing consist of the whole tar sand plus net additions of process water less only the recovered bitumen product. Tar sand tailings can be subdivided into three categories: (1) screen oversize; (2) sand tailings—the fraction that settles rapidly, and (3) middlings—the fraction that settles slowly. Screen oversize is typically collected and handled as a separate stream.

Tailings disposal in all the operations is required to place the tailings in a final resting place. Because the tailings contain bitumen emulsions, finely dispersed clay with poor settling characteristics and other contaminants, water pollution considerations prohibit discarding the tailings into rivers, lakes or other natural bodies. Currently, the tailings are stored in retention ponds (also referred to as evaportion ponds) which involve large space requirements and the construction of expensive enclosure dikes. A portion of the water in the tailings can be recycled back into the water extraction process as an economic measure to conserve water. Currently, two main operating modes for tailings disposal are (1) dike building—hydraulic conveying of tailings followed by mechanical compaction of the sand tailings fraction; and (2) overboarding—hydraulic transport with no mechanical compaction.

At one commerical location, for dike building, tailings are conveyed hydraulically to the disposal area and discharged onto the top of a sand dike which is constructed to serve as an impoundment for a pool of liquid contained inside. On the dike, sand settles rapidly and a slurry of water, silt, clay and minor amount of bitumen, as well as any chemical used during processing flows into the pond interior. The settled sand is mechanically compacted to build the dike to a higher level. The slurry which drains into the pond interior commences stratification in settling over a time scale of months to years. As a result of this long term settling, three layers form. The top layer, e.g., 5–10 feet of the pool, is a layer of relatively clear water containing minor amounts of solid, e.g., up to 5 wt.% and any dissolved chemicals. This layer of pond water can be recycled to the water extraction process without interfering with extraction of bitumen from tar sands. Below this clear water layer is a discontinuity in solid contents. Over a few feet, solids content increases to about 10–15 wt.% and thereafter, solids content increase regularly toward the pond bottom. In the deeper parts of the pond, solid contents of over 50 wt.% have been measured. This second layer is commonly called the sludge layer. In general the sludge layer can be characterized as having more than 10 wt.% of solids (which is defined as mineral plus bitumen). More particularly, the sludge can be characterized as having 15 wt.% to 65 wt.% solids. Also the sludge can be characterized as having about 0.5 to about 20 wt.% bitumen. The solids contents of the sludge layer increase regularly from top to bottom by a factor of about 4–5. Portions of the solids are clays. The clays, dispersed by the processing, apparently have partially reflocculated into a fragile gel network. Through this gel, particles of larger-than-clay sizes are slowly settling. Generally this sludge layer cannot be recycled to the separation step because no additional bitumen is extracted. A third layer formed of sand also exists.

Overboarding is the operation in which tailings are discharged over the top of the sand dike directly into the liquid pool. A rapid and slow settling process occurs but this distinction is not as sharp as in the previously described dike building and no mechanical compaction is carried out. The sand portion of the tailings settles rapidly to form a gently sloping beach, extending from the discharge point toward the pond interior. As the sand settles, a slurry drains into the pool and commences long-term settling. Thus aqueous dispersions in ponds prepared by both dike building and overboarding can be included in the general definition of sludge in the present description.

Methods for treating sludge formed in a retention pond used to store tailings from a hot water extraction of bitumen from tar sands are disclosed in Canadian Pat. Nos. 975,696; 975,697; 975,698; 975,699 and 975,700; all issued Oct. 7, 1975 to H. J. Davitt. The first mentioned Canadian Patent discloses removing sludge from a pond, placing the sludge in an air scavenger treating zone wherein the sludge is aerated and agitated concurrently, to form an upper bitumen froth layer and a lower tailings of water and mineral water. The lower tailings can be discharged into a retention pond. The upper bitumen froth is sent to a settling zone wherein two layers are formed, an upper bitumen layer reduced in mineral matter and water and a lower layer comprised substantially of mineral matter and water with minor amounts of bitumen. The latter lower layer is recycled back to the air scavenger treating zone while the upper bitumen layer is processed further to recover the bitumen. This Canadian Patent and the others also disclose that sodium silicate can improve bitumen recovery when used in connection with the aeration and agitation. Canadian Pat. No. 975,697 discloses a process similar to that described in the previous patent with an additional step in that a portion of the lower layer, which otherwise would be recycled back to the air scavenger treating zone, is returned to the retention pond. Canadian Pat. No. 975,698 discloses feeding the sludge from a retention pond to an air pressure zone wherein the sludge is aerated at superatmospheric pressure to aerate bitumen in the sludge and then releasing the pressure prior to sending the aerated material to a settling zone. Canadian Pat. No. 975,699 discloses feeding sludge recovered from a retention pond to a settling zone and permitting the sludge to form an upper froth layer and a lower tailings layer. Canadian Pat. No. 975,700 discloses feeding sludge to an air scavenger treating zone wherein the sludge is aerated and agitated concurrently and resulting froth is separated in the scavenger treating zone while the tailings are returned to the pond. However, none of the foregoing Canadian Patents discloses or suggests applicant's method of milling a bituminous oil-in-water emulsion.

U.S. Pat. No. 4,018,664, F. A. Bain, Apr. 19, 1977, discloses a method for treating sludge from a retention pond associated with hot water extraction of bitumen from bitumen sands. The method involves withdrawing sludge from a pond, diluting and mixing it with water, and settling to obtain a froth layer, a middle layer containing less solids than the original sludge, and a lower layer containing increased solids over the original sludge. Agitation and/or aeration, for example, aeration sufficient to mildly agitate the sludge, are disclosed as beneficial and essential to the extent that proper mixing is achieved. Proper mixing presumably means that the sludge and dilution water are in such close association that samples taken anywhere in the mixture all would contain essentially the same amount of water. However, it does not suggest applicant's method of milling of a bituminous oil-in-water emulsion.

Canadian Pat. No. 842,203, W. H. Seitzer, et al., May 19, 1970 discloses kneading-agglomerating a mixture of tar sands and water while the mixture flows upward in an inclined treating zone, removing the treated mixture from the upper portion of the zone, and separately recovering sand, water and tar agglomerates. The kneading-agglomerating action is imposed by apparatus with counter-rotating blades or propellers. The agglomerates are spheres containing about 28.6 wt.% to about 35.4 wt.% oil; 46.2 to 52.6 wt.% mineral (sand, clay and silt) and the balance water.

U.S. Pat. No. 3,268,071, I. E. Puddington, et al, Aug. 23, 1966, disclosed ball or rod milling tar sands, containing about 15 wt.% oil in finely divided silica and clay, in a large excess of cold water. After about one to three hours the oil agglomerated and a major proportion of the silica and clay remained suspended in the water. The agglomerates consisted of about 72–74% oil and 26–28% sand and small amounts of water. In contrast applicant's method does not form agglomerates, but causes the oil to coalesce and the coalesced oil contains less minerals and more water than the agglomerates.

U.S. Pat. No. 3,556,980, L. Clark, et al, Jan. 19, 1971, discloses treating bituminous emulsions obtained from the hot water process for recovery of bitumen from tar sands by applying shearing force to the emulsion to coalesce water and then recovering bitumen from the coalesced water. The bitumen product contains in excess of about 77 wt.% oil, less than about 18 wt.% water and solids in an amount of about 5–8 wt.%. In contrast, applicant's method involves the use of milling rather than shearing and produces a product containing more water.

Other patents which disclose use of shearing include U.S. Pat. No. 3,560,371, V. P. Kaminsky, Feb. 2, 1971 which discloses the application of shearing to an aqueous slurry of bituminous sand thereby reducing the size of the bitumen particles and improving the recovery of bitumen. U.S. Pat. No. 4,096,057, B. T. Porritt, et al June 20, 1978, also discloses the application of shear to tar sands.

SUMMARY OF THE INVENTION

Present invention is a method for processing a bituminous oil-in-water emulsion. The emulsion can be obtained from treating tar sands. The method comprises milling the emulsion for a sufficient time and then afterwards allowing a bitumen-rich liquid fraction to rise to the surface of the milled emulsion. The fraction is separated from the water fraction which contains relatively large amounts of minerals. Water can be added to the emulsion prior to or during milling.

DESCRIPTION OF THE DRAWING

The attached drawing is a schematic representation of how applicant's method can be used in connection with a hot water tar sands extracting process. The method can be used to further process one or several froths produced in the extraction process.

DETAILED DESCRIPTION

Referring now to the single FIGURE, tar sands are fed into the system through a line 1 and pass to a conditioning drum (or muller) 30. Water and steam are introduced to the drum 30 through another line 2. The total water so introduced in liquid and vapor form is a minor amount based on the weight of the tar sands processed. The tar sands conditioned with water, pass through a line 3 to the feed sump 31 which serves as a zone for diluting the pulp with additional water via line 20 before passage to the separation zone 32. The additional water may be clear pond water.

The pulp tar sands are continuously flushed from the feed sump 31 through a line 4 into separator zone 32. The settling zone within the separator 32 is relatively quiescent so that bitumen froth, which is a bituminous oil in water emulsion, rises to the top and is withdrawn via line 5 while the bulk of the sand settles to the bottom as a tailings layer which is withdrawn through line 6.

The froth, a bituminous oil-in-water emulsion, from separator 32 via line 5 can be fed to milling and separation zone 50. The froth can be blended with additional water prior to milling or the water can be added during the milling. Within milling and separation zone 50 the froth can be subjected to milling for a sufficient amount of time so that after milling a bitumen oil-rich liquid fraction rises to the surface of the milled emulsion. The oil-rich fraction is separated and can be sent as shown to the froth settler zone 34 or fed via line 61 to a froth conversion process (not shown) which converts the froth to fuel products. The bitumen-poor fraction via line 60 can be discharged to the pond 35 or another pond (not shown).

A middlings stream is withdrawn through line 7 to be processed as described below. Another middlings stream, which is relatively bitumen-rich compared to the stream withdrawn through line 7, is withdrawn from the unit via line 8 to a flotation scavenger zone 33. In this zone, an air flotation operation is conducted to cause the formation of additional bitumen froth, a bituminous oil-in-water emulsion, which passes from the scavenger zone through line 9 in mixture with the primary froth from the separator 32 to a froth settler 34. A bitumen-lean water stream is removed from the bottom of the scavenger zone 33 through line 10 to be further processed as described hereinafter. In the settler zone 34, some further bitumen-lean water is withdrawn from the froth and removed through line 11 to be mixed with the bitumen-lean water stream from the flotation scavenger zone 33, the sand tailings stream from the separation zone 32 and a portion of the lower middlings withdrawn via line 21 from the separation zone 32. The bitumen froth from the settler 34 is removed through line 12 for further treatment.

In the foregoing description the bitumen froth obtained from the flotation scavenger zone 33 can be fed to another milling and separation zone (not shown) similar to zone 50 or to milling and separation zone 50. The froth can be blended with additional water prior to milling or the water can be added during the milling. Within the milling and separation zone the froth from zone 33 is subjected to milling for a sufficient amount of time so that after milling a bitumen oil-rich liquid fraction rises to the surface of the milled emulsion. The oil-rich fraction can be separated and can be sent as shown to the froth settler zone 34 or fed to a froth conversion process (not shown) which converts the froth to fuel products. The bitumen-poor fraction can be charged to the pond 35 or another pond (not shown).

Alternatively, the froth from separator 32 and the froth from the flotation scavenger zone 33 are combined and the combined froths could be fed to a milling and separation zone (not shown) similar to milling and separation zone 50. Additional water can be added prior to milling or during milling. Within the milling and separation zone the combined froths are subjected to milling for a sufficient amount of time so that after milling a bitumen oil-rich liquid fraction rises to the surface of the milled emulsion. The oil-rich fraction can be separated and can be sent to froth settling zone 34 or fed to a froth conversion process (not shown) which converts the froth to fuel products. The bitumen-poor fraction can be charged to pond 35 or another pond (not shown).

In another alternative, the bitumen froth from settler 34 removed through line 12 is fed to a milling and separation zone (not shown) similar to milling and separation zone 50. The froth can be blended with additional water prior to milling or the water added during milling. Within the milling and separation zone the bitumen froth is subjected to milling for a sufficient amount of time so that after milling a bitumen oil-rich liquid fraction rises to the surface of the milled emulsion. The oil-rich fraction can be separated and can be sent to a froth conversion process (not shown) which converts the froth to fuel products. The bitumen poor fraction can be charged to pond 35 or another pond (not shown).

The bitumen-lean water from the froth settler 34, the scavenger zone 33 and the separator 32, together make up a tailing discharge stream which can be collected and handled via a dike building or overboarding operation previously described. The tailing discharge stream, via line 13, can be fed to distribution pipe 14. The distribution piping provides for continuous and uniform delivery of the effluent 15 to the pond 35. The latter can be considered another separation zone; it is a zone of quietness. Both the dike building and overboarding operation result in what is commonly referred to as a pond, particularly a retention pond. As previously described three layers are formed in the pond. They are (1) a top water layer relatively free of clay and bitumen and which can be recycled; (2) a middle layer consisting of bitumen and mineral (defined as not being soluble in toluene); and (3) a bottom layer having a relatively high concentration of sand. The middle layer is often referred to as sludge.

The sludge is continuously being formed in a time span of many months and even years. As a result its characteristics are different from those of the middlings layer drawn off from the separation zone 32 via lines 7 and 8. One of the differences is that the middlings layer has a higher pH (e.g., about 8.4) whereas the sludge has a lower pH (e.g., about 7.4). The differences in pH reflect changes which are not fully understood but which are occurring in the pond. Another difference between the sludge and middlings streams (via line 7 and 8) is the weight percent of mineral, e.g., the middlings stream contains about 8–12 wt.% whereas the sludge contains a higher weight %, at least about 15 wt. %, e.g. about 15–65 wt. %.

Applicant's method can also treat the sludge from the pond 35. As stated heretofore bituminous oil-in-water emulsion feed to applicant's method can contain relatively large amounts of minerals and such a definition includes sludge obtained from a retention pond such as 35. The sludge from the pond can be fed to a milling and separation zone (not shown) similar to milling and separation zone 50 or to zone 50. Within the milling and separating zone the sludge from pond 35 can be subjected to milling for a sufficient amount of time so that after milling, a bitumen oil-rich liquid fraction rises to the surface of the milled emulsion. The oil-rich fraction can be separated and can be sent to the froth settler zone 34 or fed to a froth conversion process (not shown) which converts the froth to fuel products. The bitumen-poor fraction can be returned to pond 35 or another pond (not shown).

As an alternative the sludge from pond 35 can be treated (not shown) to first form a bituminous oil-in-water emulsion having a relatively small amount of minerals or in other words, a froth. The latter also could be fed to a milling and separation zone similar to zone 50. Within the milling and separation operation the froth is subjected to milling for a sufficient amount of time so that after milling a bitumen oil-rich liquid fraction rises to the surface of the milled emulsion. The oil-rich fraction can be separated and can be sent to a froth conversion process (not shown) which converts the froth to fuel products. The bitumen-poor fraction can be returned to pond 35 or another pond (not shown).

As used herein "milling" refers to an application of force which is a shaping or crushing action imparted by milling surfaces on material, as in a ball mill (balls) or paint mill (rollers). The milling action is distinguishable from a shearing action which is a cutting force tending to disperse smaller and smaller material rather than to compress material together. The milling action is also distinguishable from a kneading-agglomerating action described in Canadian Pat. No. 842,203, W. H. Seitzer, et al, May 19, 1970 which can be imposed by an apparatus with counter-rotating blades or propellers.

The temperature of the milling can vary widely. Generally the temperature used is between the freezing and boiling points of the emulsion. The preferred temperature range is between about 10° C. to about 50° C. Duration of milling will depend on milling speed, minerals and other content of the bitumen emulsion, milling temperature, and other factors known to those skilled in the art. Generally, several minutes to an hour or more will be sufficient, as determined by the amount of bitumen-rich liquid fraction rising to the surface.

The following examples will illustrate the usefulness of the present invention in additional recovery of bitumen from various emulsions.

EXAMPLES

A batch ball mill was charged with 500 grams of feed in each of three runs. The feeds were a sludge, a primary froth, and a demineralized froth, respectively. The procedure used to prepare the three feeds is described hereinafter as well as their properties. The mill, a 5 liter jar, contained 19 Burundum cyclinders of the dimensions 21×21 mm. After charging, the mill was rotated for the times indicated hereinafter. Then the mill was stopped and the jar opened and the bitumen layer was skimmed off the surface to obtain the product reported below.

With sludge as the feed and with an hour of operating mill time the data shown in Table I were obtained.

TABLE I

Milling of Sludge Increases Bitumen Recovery

| | Wt. % | | | Recovery - Wt. % | |
|---|---|---|---|---|---|
| | Bitumen | Mineral | Water | Actual | Estimated |
| Sludge | 8 | 25 | 67 | — | — |
| Product | 25 | 21 | 54 | 61 | 73 |

The estimated recovery includes the material not removed from the cylinders and walls of the jar. The sludge was obtained from a pond in which water tailings from a hot-water tar sand process was stored. As can be seen from the comparison of the contents of the sludge and the product produced by applicant's method, milling of sludge can result in increasing bitumen recovery.

With primary froth as the feed and with one and five hours of operating mill time the data shown in Table II were obtained.

TABLE II

Milling of Froth Increases Bitumen Recovery

| | Wt. % | | | Recovery - Wt. % | |
|---|---|---|---|---|---|
| | Bitumen | Mineral | Water | Actual | Estimated |
| Primary Froth | 12 | 22 | 66 | — | — |
| Product (1 hr.) | 61 | 9 | 30 | 92 | 94 |
| Product (5 hr.) | 63 | 8 | 29 | 88 | 89 |

As can be seen from the comparison of the contents of the froth and product (1 hr.) the milling of the froth resulted in producing a product which contained almost all the bitumen. However, the data also suggests that longer milling times (5 hrs.) do not necessarily increase recovery.

The primary froth was prepared in the following manner. The same type of sludge used to obtain the data for Table I was charged to a laboratory Wemco cell. Also charged to the cell was 90 ppm sodium silicate. The cell was activated and the agitation-aeration (shearing) continued for 10 minutes. The agitation-aeration was then stopped and after 10 minutes the formed froth removed. Then the agitation-aeration was continued for 10 minutes and so on until the charged cell had been agitated for 70 minutes. The froths removed at the end of each 10 minute run were combined and some of the froth used as a feed to the ball mill.

With a demineralized froth a run was conducted using a one-liter jar charged with 200 gms. of the froth and 1 hour operating mill time. The results are shown in Table III.

TABLE III

Milling of Demineralized Froth Increases Bitumen Recovery

| | Wt. % | | | Recovery - Wt. % | |
|---|---|---|---|---|---|
| | Bitumen | Mineral | Water | Actual | Estimated |
| Demineralized Froth | 26 | 14 | 60 | — | — |
| Product | 63 | 6 | 21 | 99.4 | 99.6 |

As the data indicates, milling a demineralized froth results in a very high bitumen recovery.

The demineralized froth was obtained by diluting primary froth with an equal weight of pond water and then charging the diluted mixture to a laboratory Wemco cell. The agitation-aeration in the cell was for five minutes followed by ten minutes quiescence. After the quiescence demineralized froth was skimmed from the cell.

The products obtained from the runs used to obtain the data reported in Tables II and III were a water-in-oil emulsion rather than an oil-in-water emulsion as obtained by milling sludge (reported in Table I).

All of the foregoing runs were performed at room temperature.

Other bituminous oil-in-water emulsions can be milled as described heretofore with similar high recoveries of bitumen obtained.

I claim:

1. A method for separating bitumen from a bituminous oil-in-water emulsion froth comprising:
   (a) milling at a temperature between about 10° and about 50° C. with a ball mill, roller mill or equivalent milling device, a bituminous oil-in-water emulsion froth from a tar sands extraction process containing from about 12 to about 26 wt. % bitumen to impart a crushing action on said emulsion froth and effect coalescence of bitumen;
   (b) allowing a bitumen-rich liquid fraction to rise to the surface of the milled emulsion; and
   (c) separating said bitumen-rich fraction, wherein the separated bitumen-rich fraction contains a smaller amount of minerals relative to the amount of minerals in the starting oil-in-water emulsion.

2. Method according to claim 1 wherein the separated bitumen-rich liquid fraction is a water in oil emulsion.

3. Method according to claim 1 wherein water is added to the starting emulsion froth.

4. Method according to claim 1 wherein water is added during milling of the emulsion froth.

5. Method according to claim 1 wherein the starting emulsion froth is a froth derived from tailings pond sludge.

* * * * *